US008915721B2

(12) United States Patent
Winkler et al.

(10) Patent No.: US 8,915,721 B2
(45) Date of Patent: Dec. 23, 2014

(54) MINI FAN

(75) Inventors: Wolfgang Arno Winkler, St. Georgen (DE); Nils Rapp, St. Georgen (DE)

(73) Assignee: EBM-Papst St. Georgen GmbH & Co. KG, St. Georgen (DE)

( * ) Notice: Subject to any disclaimer, the term of this patent is extended or adjusted under 35 U.S.C. 154(b) by 0 days.

(21) Appl. No.: 10/562,628

(22) PCT Filed: May 11, 2004

(86) PCT No.: PCT/EP2004/005017

§ 371 (c)(1),
(2), (4) Date: Dec. 22, 2005

(87) PCT Pub. No.: WO2005/008072

PCT Pub. Date: Jan. 27, 2005

(65) Prior Publication Data

US 2006/0153677 A1 Jul. 13, 2006

(30) Foreign Application Priority Data

Jul. 16, 2003 (DE) ..... 203 11 307
Mar. 30, 2004 (DE) ..... 20 2004 005 341 U

(51) Int. Cl.

| | |
|---|---|
| ***F04B 35/04*** | (2006.01) |
| ***F04D 29/063*** | (2006.01) |
| ***F04D 29/057*** | (2006.01) |
| ***F04D 29/64*** | (2006.01) |
| ***F04D 25/06*** | (2006.01) |

(52) U.S. Cl.

CPC ..... *F04D 29/063* (2013.01); *F04D 29/057* (2013.01); *F04D 29/646* (2013.01); *F04D 25/062* (2013.01)

USPC ..... 417/423.12; 417/354

(58) Field of Classification Search

USPC ..... 417/354, 423.12; 384/100, 107, 114, 384/115, 903, 121, 122; 310/67 R, 90, 91; 29/525.14; 156/272.8; 403/270–272

See application file for complete search history.

(56) References Cited

U.S. PATENT DOCUMENTS 4,737,673 A 4/1988 Wrobel ..... 310/90
4,783,608 A * 11/1988 Gruber et al. ..... 310/90

(Continued)

FOREIGN PATENT DOCUMENTS

DE 37 31 710 A 3/1988
DE 296 18 979 U1 2/1997

(Continued)

OTHER PUBLICATIONS

Machine Translation of Japanese Patent JP 2002171712 A to Ono et al on Jun. 14, 2002, title: "Spindle motor for disk drive, has stopper to regulate elutriation of axial holder and shaft, which is engaged with recess formed in shaft".*

(Continued)

*Primary Examiner* — Peter J Bertheaud
*Assistant Examiner* — Dnyanesh Kasture
(74) *Attorney, Agent, or Firm* — Milton Oliver, Esq.; Oliver Intellectual Property LLC

(57) ABSTRACT

A mini-fan has a drive motor having an external rotor (222) and an internal stator (244). The external rotor (222) is equipped with a rotor shaft (234) that has a necked down portion (258) in the region of its free end (235). The mini-fan (216) has a bearing tube (238) on whose outer side the internal stator (244) is mounted and in whose interior is arranged a bearing arrangement (236) in which the rotor shaft (234) is rotatably supported. A closure arrangement (262) serves to close off the bearing tube (238) in liquid-tight fashion at one end, and is equipped, in the region of the necked down portion (258) of the rotor shaft (234), with at least one resilient securing member (260) that engages into that necked down portion (258) and secures the rotor shaft (234) against being pulled out of the bearing arrangement (236).

34 Claims, 7 Drawing Sheets

(56) References Cited

U.S. PATENT DOCUMENTS

| | | | | |
|---|---|---|---|---|
| 5,264,748 | A * | 11/1993 | Ootsuka et al. | 310/90 |
| 5,610,462 | A * | 3/1997 | Takahashi | 310/90 |
| 5,797,181 | A | 8/1998 | Robinson | 29/888.024 |
| 6,246,140 | B1 | 6/2001 | Horng | 310/91 |
| 6,276,833 | B1 | 8/2001 | Chen | 384/226 |
| 6,318,976 | B1 * | 11/2001 | Hsieh | 417/423.12 |
| 6,414,411 | B1 * | 7/2002 | Horng et al. | 310/194 |
| 6,498,412 | B2 * | 12/2002 | Horng | 310/91 |
| 6,517,318 | B2 | 2/2003 | Hsieh | 416/174 |
| 6,520,476 | B1 | 2/2003 | Chuang | 248/694 |
| 6,544,011 | B2 | 4/2003 | Hsieh | 417/423.7 |
| 6,617,736 | B1 * | 9/2003 | Horng et al. | 310/91 |
| 6,756,714 | B2 * | 6/2004 | Alex et al. | 310/90 |
| 6,819,021 | B1 * | 11/2004 | Horng et al. | 310/91 |
| 6,832,853 | B2 * | 12/2004 | Fujinaka | 384/100 |
| 2002/0060954 | A1 * | 5/2002 | Schafroth et al. | 368/204 |
| 2002/0090299 | A1 | 7/2002 | Chuang | 416/182 |
| 2002/0176804 | A1 * | 11/2002 | Strand et al. | 422/100 |
| 2002/0179233 | A1 * | 12/2002 | Ruotsalainen | 156/272.8 |
| 2003/0042811 | A1 | 3/2003 | Lin | 310/90 |
| 2003/0113045 | A1 * | 6/2003 | Fujinaka | 384/100 |
| 2003/0130381 | A1 * | 7/2003 | Joachimi et al. | 524/88 |
| 2004/0201298 | A1 * | 10/2004 | Horng et al. | 310/91 |

FOREIGN PATENT DOCUMENTS

| | | | | | |
|---|---|---|---|---|---|
| DE | 198 48 291 | A | | 4/1999 | |
| DE | 100 31 137 | | | 2/2001 | |
| DE | 201 18 024 | U | | 2/2002 | |
| DE | 100 62 446 | A | | 7/2002 | |
| EP | 0 843 099 | A3 | | 5/1998 | |
| GB | 2332989 | | | 7/1999 | |
| JP | 2002-031088 | A | | 1/2002 | |
| JP | 2002031088 | A | * | 1/2002 | F04D 29/32 |
| JP | 2002171712 | A | * | 6/2002 | H02K 1/22 |
| WO | WO 02-10602 | A | | 2/2002 | |

OTHER PUBLICATIONS

English Language Translation of Japanese Patent JP 2002031088 A to Hoshina et al.*

Translation of German Patent DE 20118024-U1, dated Feb. 2002.*

Patent Abstracts of Japan, English abs. of JP 2002-031088-A, Jan. 2002 (2 pp.).

Ezry Akkerman, "The Epilams," retrieved via Internet Dec. 21, 2005 (4 pp.).

* cited by examiner

MINI FAN

CROSS-REFERENCE

This application is a section 371 of PCT/EP2004/005017, filed 11 May 2004, claiming priority from German applications DE 203 11 207, filed 16 Jul. 2003 and DE 20 2004 005 341, filed 30 Mar. 2004, the disclosures of which are hereby incorporated by reference.

FIELD OF THE INVENTION

The invention relates to a mini-fan. Such fans are also referred to as miniature or subminiature fans.

BACKGROUND

Mini-fans serve, for example, to cool processors in computers, for the cooling of small equipment items, etc. and have very small dimensions.

For example:

fans of the ebm-papst 250 series have dimensions of 8×25×25 mm;

those of the ebm-papst 400F series, dimensions of 10×40×40 mm;

those of the ebm-papst 400 series, 20×40×40 mm; and those of the ebm-papst 600 series, 25×60×60 mm.

The power consumption of such fans is 0.4-0.6 W for the 250 series, 0.7-0.9 W for the 400F series, and 0.9-3.4 W for the 400 and 600 series. The weight is, for example, approximately 5 (five) grams for the 250 series, between 17 and 27 g for the 400/400F series, and approximately 85 g for the 600 series.

With fans of this miniature size, which must be very inexpensive, it is important to make assembly as simple as possible in order to enable a high level of automation during manufacture. Only extensive production automation additionally makes possible uniform quality in such fans, which is a prerequisite for a long average service life.

A complicating factor with such mini-fans is furthermore that their components, entirely comparable to those of a mechanical watch mechanism, are very delicate and therefore not robust. The rotor shaft, for example, is often only as thick as a knitting needle, and can therefore easily be bent if handled carelessly, rendering the fan unusable. This danger exists in particular during the assembly of such a mini-fan, for example when it must be acted upon by a force for assembly purposes.

SUMMARY OF THE INVENTION

An object of the invention is therefore to make available a novel mini-fan. According to the invention, this object is achieved by configuring the fan motor with an internal stator and external rotor, the rotor being rotatably supported in a bearing tube equipped with a closure arrangement which closes off one end of the bearing tube in a liquid-tight manner, and includes at least one resilient securing member to engage into a necked down portion of the rotor shaft and thereby keep the rotor shaft from being pulled out of the bearing.

What is thereby achieved, with simple means, is a secure, liquid-tight join between the bearing tube and the closure arrangement. Because the invention makes it possible to assemble the internal stator while it is still separate from the rotor, and because the internal stator is a substantially more robust component than the external rotor, the danger of damage during the assembly operation is substantially reduced. In the context of a mini-fan according to the present invention, it is therefore possible first to assemble the internal stator; and once the latter has been, for example, soldered in place on a circuit board, the rotor can then very easily be installed and at the same time secured, by way of the at least one resilient securing member, against being inadvertently pulled out.

Further details and advantageous refinements of the invention are evident from the exemplifying embodiments, in no way to be understood as a limitation of the invention, that are described below and depicted in the drawings.

BRIEF FIGURE DESCRIPTION

DETAILED DESCRIPTION

Figure 1:
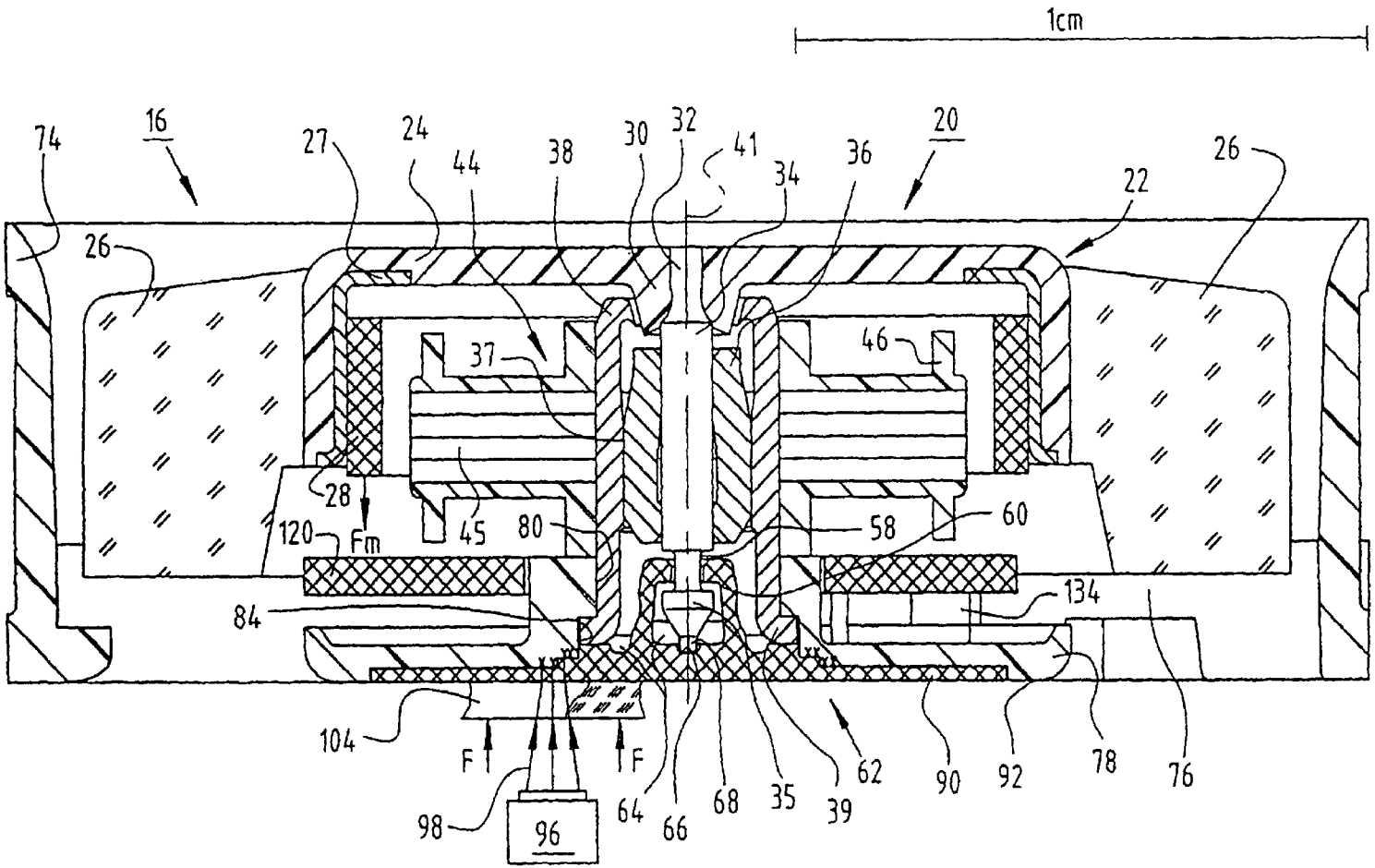
FIG. 1 is a greatly enlarged longitudinal section through a mini-fan according to a preferred embodiment of the invention; for illustration only, a one-centimeter length is indicated for comparison, although the size of the fan can of course fall within the limits typical for such miniature and subminiature fans.

FIG. 1 shows, at very greatly enlarged scale, a longitudinal section through a mini-fan 16 associated with which, for driving thereof, is an external-rotor motor 20. Fan 16 can have, for example, dimensions of 10×30×30 mm. Motor 20 has an external rotor 22 having a rotor cup 24, preferably made of a thermally conductive plastic, on whose outer periphery fan blades 26 are provided. A magnetic yoke 27 made of soft iron is mounted in rotor cup 24, and on the yoke's inner side is a radially magnetized rotor magnet 28 that can be magnetized, for example, with four poles. The outside diameter of external rotor 22 can range, for example, from approximately 14 to approximately 35 mm.

Fan 16 is depicted here as an axial fan, but the invention is equally applicable, for example, to diagonal fans and to radial fans.

Rotor cup 24 has at its center a hub 30 in which is mounted, in thermally conductive fashion by plastic injection molding, a correspondingly shaped upper shaft end 32 of a rotor shaft 34 whose lower, free end is labeled 35.

Radial support of shaft 34 is provided by a plain bearing 36 that preferably is implemented as a sintered bearing. Alternatively in the context of the invention, in order to achieve a particularly long service life, shaft 34 can also be supported using rolling bearings. Plain bearing 36 is mounted by being pressed into the interior of a constriction 37 of a bearing tube 38. Bearing tube 38 is preferably manufactured from steel, brass, or another suitable metal, or if applicable also from a plastic. Provided at its lower end is a radial projection in the form of a flange 39, which serves for the mounting of fan 16 and here extends approximately perpendicular to rotation axis 41 of rotor 22. Internal stator 44 of motor 20 is mounted on the outer side of bearing tube 38 by being pressed on.

Constriction 37 has a substantially cylindrical inner side 40 (FIGS. 2 and 3) whose surface is particularly carefully machined, while the remainder of the inner side of bearing tube 38 needs to be only roughly machined. Corresponding to constriction 37, sintered bearing 36 has a bulging portion 42 having a diameter that corresponds approximately to the diameter of inner side 40 and is dimensioned so that a tight fit results upon assembly in inner side 40. Within portion 42, sintered bearing 36 has a portion 43 (FIG. 2) having an enlarged diameter, at which the sintered bearing does not make contact against shaft 34. This prevents sintered bearing 36 from being excessively radially compressed in the event of an accumulation of unfavorable tolerances, which might make it impossible to insert shaft 34.

Figure 2:
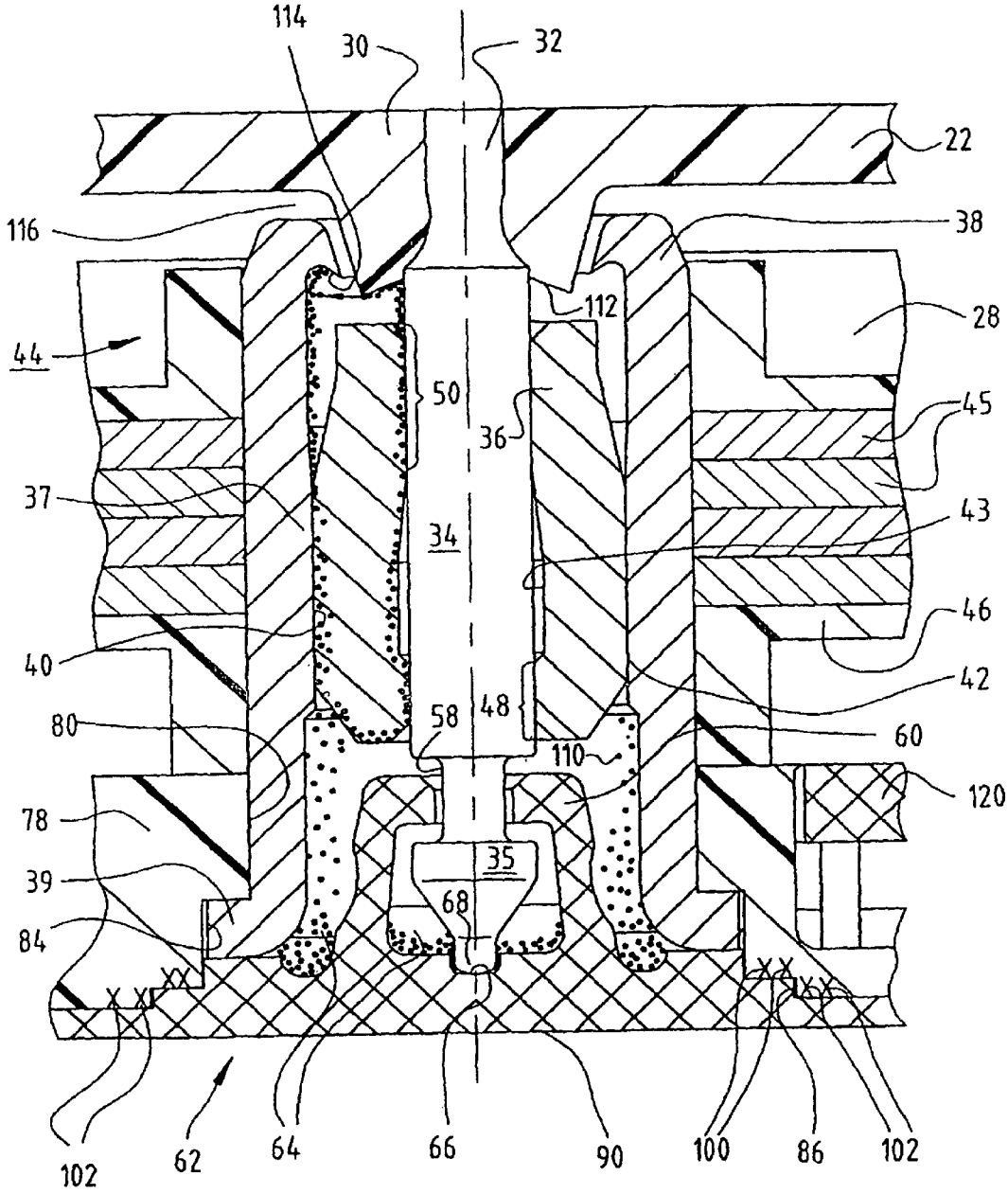
FIG. 2 is an even greater enlargement to explain the lubricant circulation in the bearing arrangement with plain bearing that is depicted.
Figure 3:
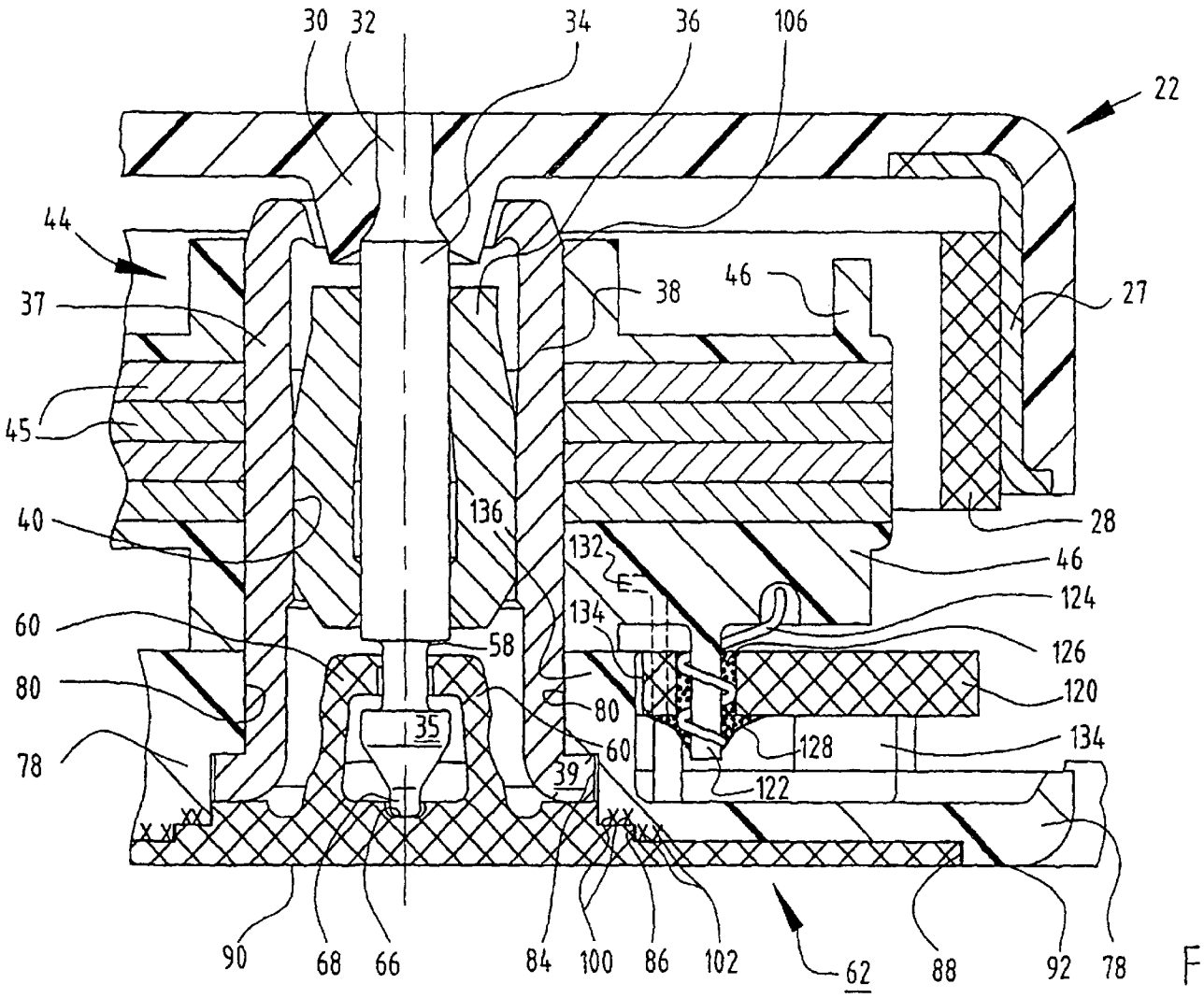
FIG. 3 depicts one possible variant for connecting the stator winding of the external-rotor motor according to FIGS. 1 and 2 to a circuit board.
Figure 4:
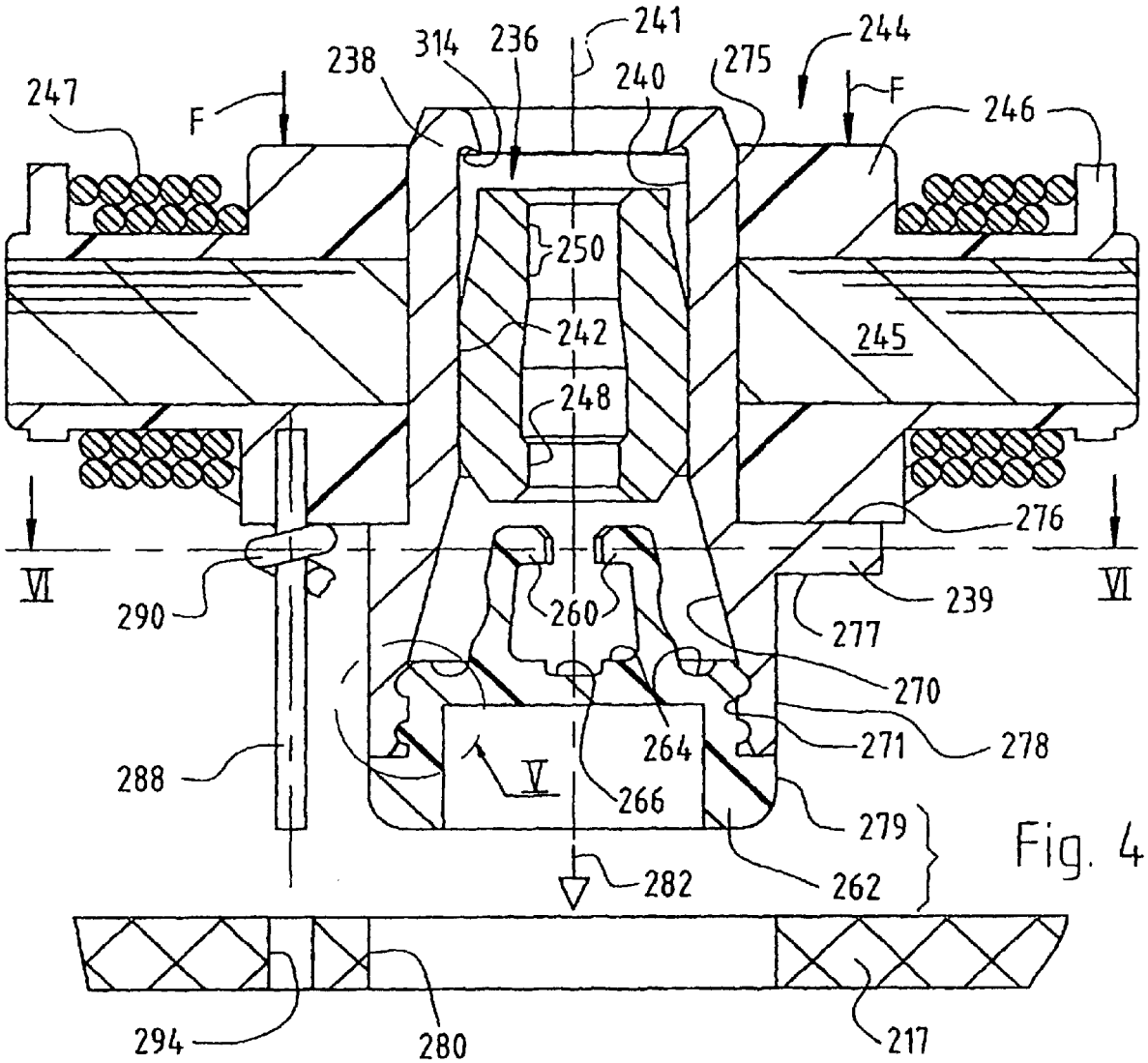
FIG. 4 is a very greatly enlarged longitudinal section through a mini-fan according a second embodiment of the invention.
Figure 5:
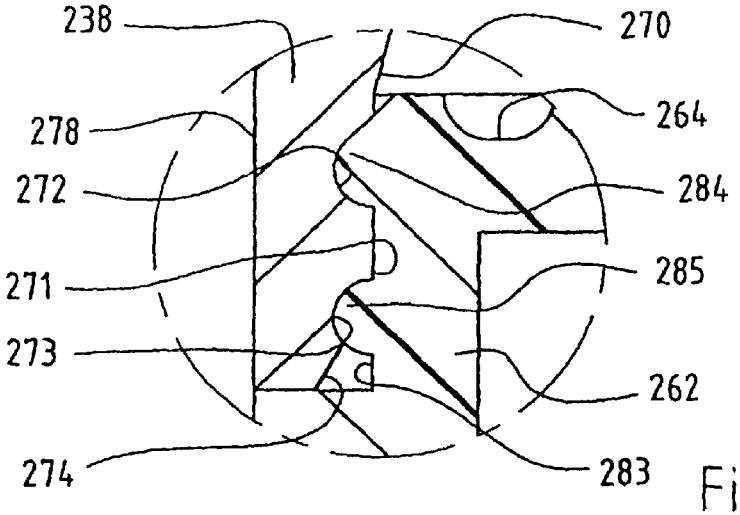
FIG. 5 shows a portion of FIG. 4 at location V therein.
Figure 6:
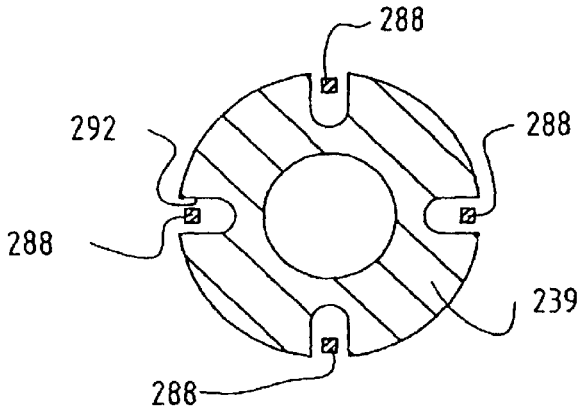
FIG. 6 is a section according to a first alternative, looking along line VI-VI of FIG. 4.
Figure 7:
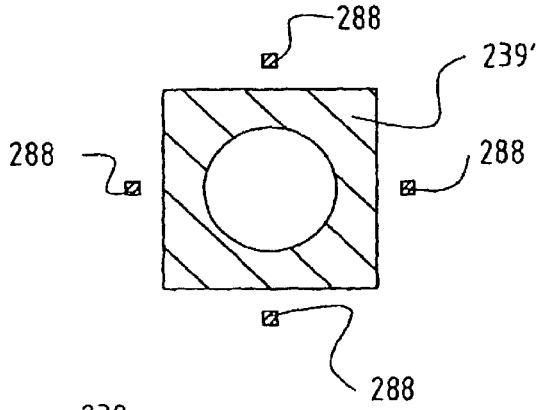
FIG. 7 is a section according to a second alternative, looking along line VI-VI of FIG. 4.
Figure 8:
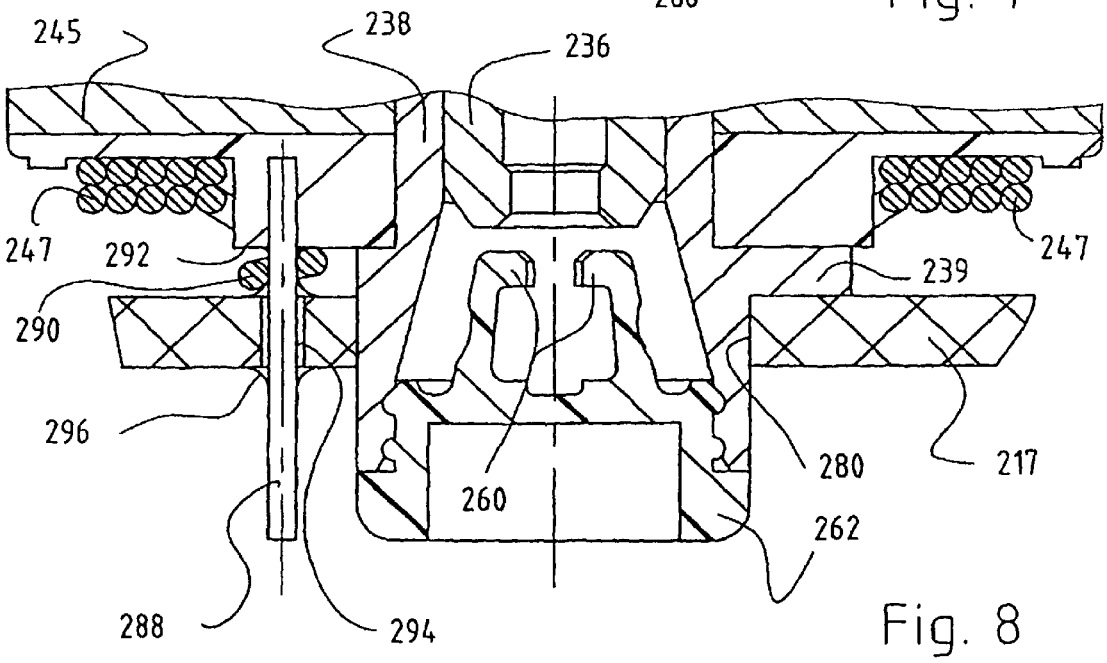
FIG. 8 is a section analogous to FIG. 4, but after the mating of the internal stator and circuit board.
Figure 9:
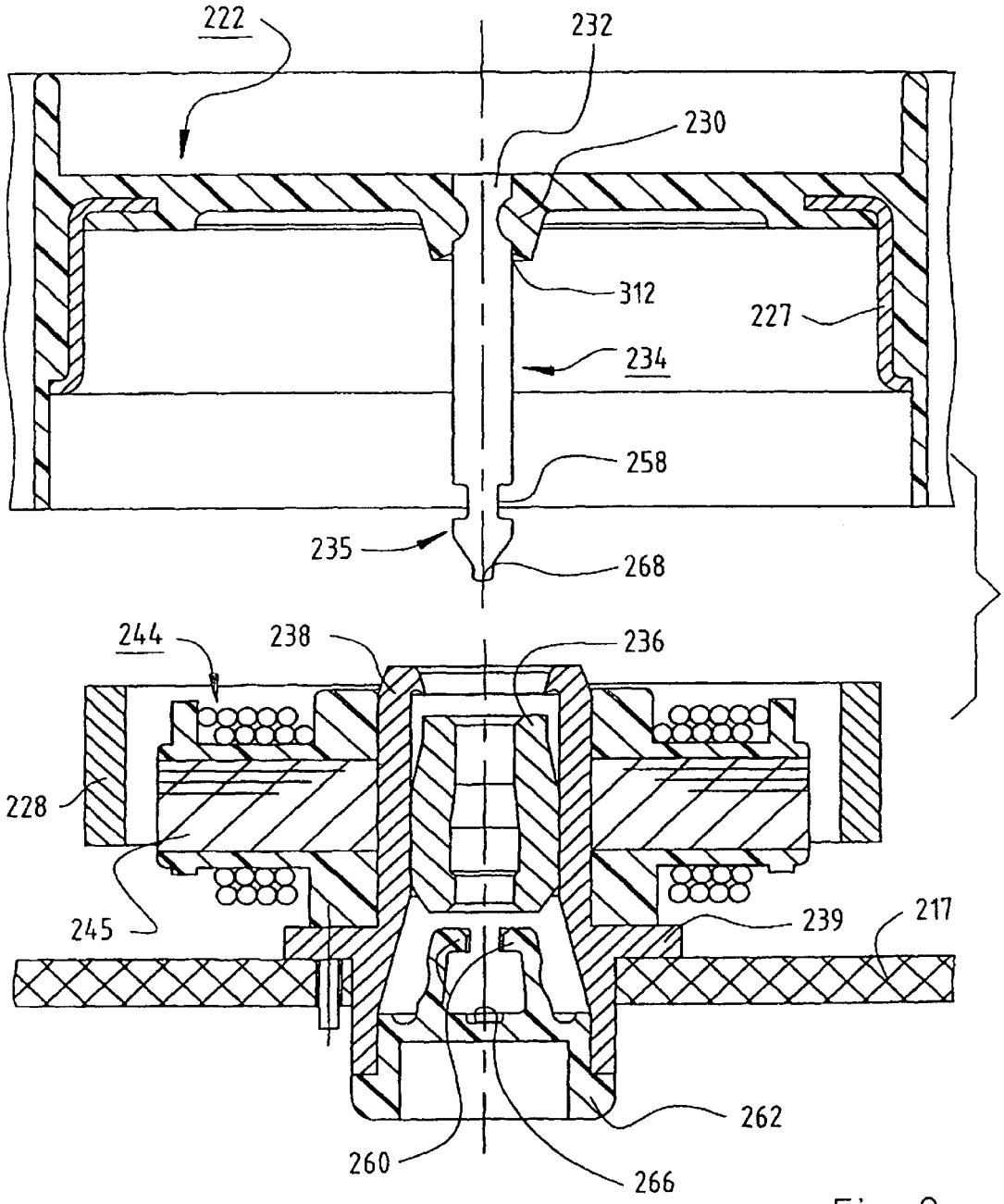
FIG. 9 is a depiction analogous to FIG. 8, but before the mating of the internal stator and external rotor.
Figure 10:
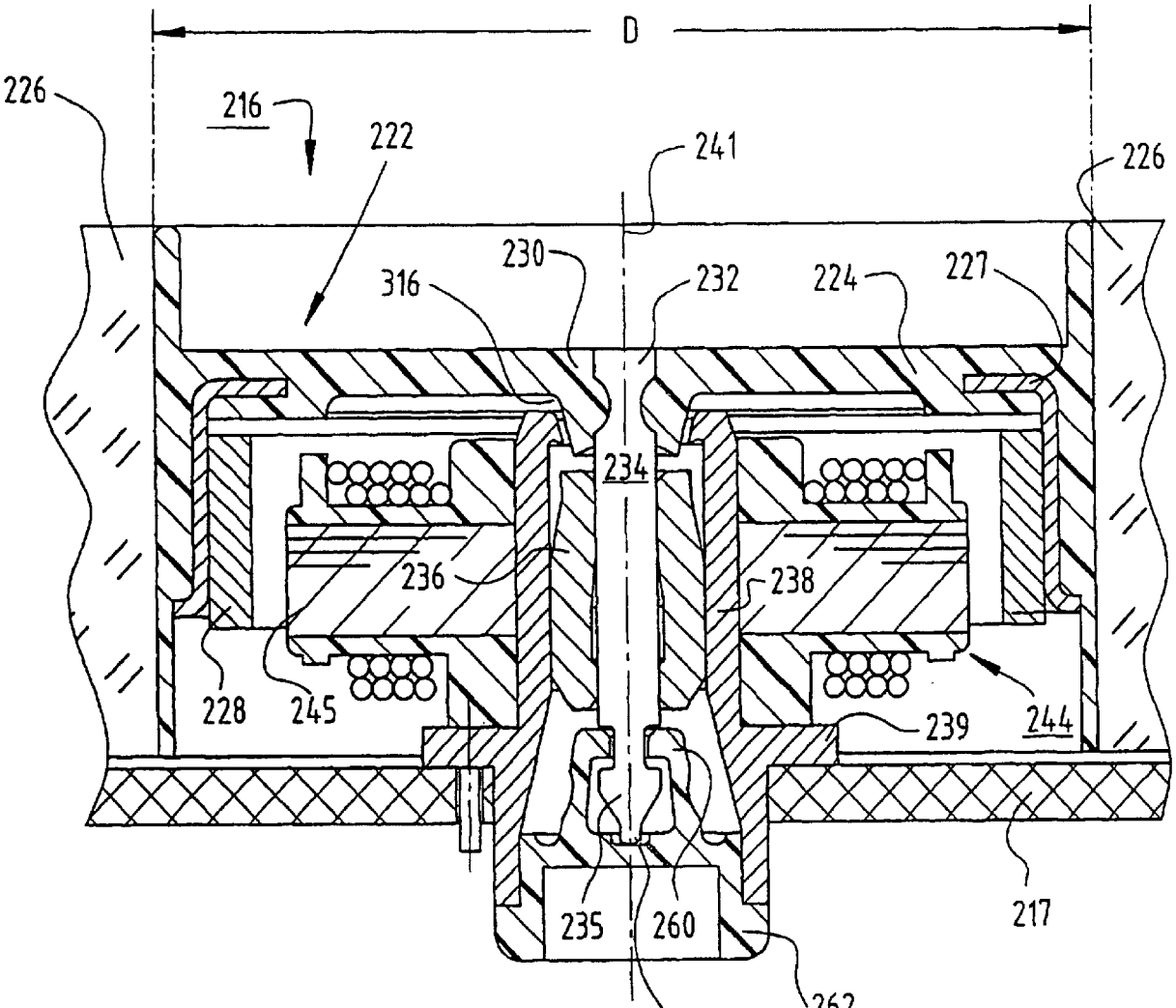
FIG. 10 is a depiction analogous to FIG. 9, but after the mating of the internal stator and external rotor; the external rotor is secured on the internal stator against being pulled out, and the lower (in FIG. 10) side of the bearing support tube is closed off in liquid-tight fashion.

A lower plain bearing portion 48 is located below portion 43, and an upper plain bearing portion 50 is located above portion 43 (cf. FIG. 2). It has been found that specifically in mini-fans with their small dimensions, very reliable support of shaft 34, and a correspondingly long service life for motor 20, are thereby obtained.

What is claimed is:

1. A mini-fan that comprises:

a drive motor (20) having an external rotor (22; 222) and an internal stator (44; 244), the external rotor being equipped with a rotor shaft (34; 234) that has a necked-down portion (58; 258) adjacent its free end (35; 235);

a thrust bearing (66, 68) cooperating with said free end (35; 235) of the rotor shaft (34; 234);

a bearing tube (38; 238) having an exterior, a rotor-side end and a thrust bearing-side end;

a fan housing (74) having a support flange (78) for said drive motor (20), formed with a bearing-tube-receiving opening (80) to receive said bearing tube (38, 238), said bearing tube being provided, on the thrust bearing-side end, with a radial projection (39);

said internal stator (44; 244) being secured to an exterior of said bearing tube, there being arranged, within said bearing tube, a radial bearing arrangement (36; 236) in which said rotor shaft (34; 234) is rotatably supported;

a closure arrangement (62; 262) that closes off the bearing tube (38; 238) in a fluid-tight manner at the thrust bearing-side end, and is equipped, adjacent the necked-down portion (258) of the rotor shaft (234), with a plurality of resilient radially movable latching hooks (60; 260), spaced apart from said radial bearing arrangement and acting as detents, for engaging into that necked-down portion (58; 258) of the rotor shaft (234) yet remaining spaced from the rotor shaft when the free end of the rotor shaft abuts against said thrust bearing, thereby facilitating normal operation of said rotor shaft (34; 234) while securing said rotor shaft against being pulled out of said radial bearing arrangement (36; 236), said resilient radially movable latching hooks being integrally formed with said closure arrangement (62; 262); and wherein said closure arrangement includes a cover portion (62), said cover portion (62) being secured to said support flange (78) on a cover-portion side of the support flange by a fluid-tight connection (100, 102);

wherein each radially movable latching hook (60; 260) of the plurality of resilient radially movable latching hooks (60; 260) comprises a longitudinal section that is connected on a first axial end to the cover portion (62) and on a second axial end to a transversal section that is oriented towards the necked-down portion (58; 258) of the rotor shaft (34; 234) for engaging into the necked-down portion (58; 258) of the rotor shaft (234), the longitudinal section and the transversal section being integrally formed;

wherein the longitudinal section is provided with a trough-shaped recess in an area that is spaced apart from the second axial end;

wherein the shaft (34) of the fan has said free end, which is equipped with a tracking cap (68), associated with which is a corresponding depression (66) formed in the cover portion (62), said depression (66) forming, together with the tracking cap (68), said thrust bearing for the rotor shaft (34);

wherein the tracking cap (68) has a cylindrical portion that faces a side wall of said depression (66), and wherein said cylindrical portion has an outside diameter, and wherein said side wall of said depression (66) has an inside diameter, said outside and inside diameters being smaller than an outside diameter of the rotor shaft (24; 234) in said radial bearing arrangement (36; 236);

wherein said bearing tube (38, 238) has been inserted from said cover-portion side of the support flange (78) into the bearing-tube-receiving opening (80), such that the radial projection of the bearing tube abuts against a shoulder formed on said support flange (78), and wherein said internal stator (44; 244) has been pressed from a rotor-adjacent end onto the exterior of the bearing tube, such that the internal stator abuts the support flange (78).

2. The mini-fan according to claim 1, wherein the bearing tube (38) is pressed in a fluid-tight manner into the bearing-tube-receiving opening (80) formed in the support flange (78).

3. The mini-fan according to claim 2, wherein the bearing tube (38) consists essentially of metal, and is epilam-coated on its side that is pressed into the bearing-tube-receiving opening (80) formed in the support flange.

4. The mini-fan according to claim 2, wherein the bearing tube (38) is formed with a constriction (37) in which said radial bearing arrangement (36) is mounted.

5. The mini-fan according to claim 4, wherein the inner side (40) of the constriction (37) has a better-machined surface than other, unconstricted portions of the inner side of the bearing tube (38).

6. The mini-fan according to claim 1, wherein said radial projection (39) is held in a positively engaged manner between the closure arrangement (62) and a portion of the support flange (78).

7. The mini-fan according to claim 6, wherein the radial projection is configured as an additional flange (39).

8. The mini-fan according to claim 7, wherein the additional flange (39) is provided on an end portion of the bearing tube (38).

9. The mini-fan according to claim 1, wherein the thrust bearing is equipped with a lubricant (110).

10. The mini-fan according to claim 1, wherein there is provided, adjacent the free end of the shaft (34; 234), a spreading member (35; 235) that is configured to deflect the resilient latching hooks (60; 260) in a radial direction, upon installation of the shaft (34; 234).

11. The mini-fan according to claim 1, wherein the tracking cap (68; 268) is acted upon by a magnetically generated force urging said rotor shaft in a direction toward the closure arrangement (62; 262).

12. The mini-fan according to claim 1, wherein the closure arrangement is implemented as a plug that is mounted in an opening of the bearing tube.

13. The mini-fan according to claim 12, wherein the closure arrangement is pressed in a fluid-tight manner into the opening of the bearing tube (238).

14. The mini-fan according to claim 12, wherein at a transition point (271, 283) between the bearing tube (238) and the plug (262), there is implemented, on one of those parts, an annular ridge (284, 285) and, on the other part, an annular groove (272, 273) complementary thereto, which together form a latching connection when the plug (262) is installed.

15. The mini-fan according to claim 12, wherein the bearing tube (238) has a larger inside diameter at its portion (271) provided for reception of the plug (262) than at its portion (240) provided for reception of the radial bearing arrangement (236).

16. The mini-fan according to claim 1, wherein the bearing tube (238) comprises a portion (278) that protrudes away from the rotor (222) and is configured to facilitate installation into an opening (280) of a component (217).

17. The mini-fan according to claim 1, wherein the internal stator (44; 244) comprises a lamination stack (45; 245) on which is arranged a coil former (46; 246) having a stator winding (247), and mounted on that coil former is at least one rigid electrical conductor (132; 288) that is electrically connected to the stator winding (247) and extends parallel to the rotation axis (41; 241) of the mini-fan.

18. The mini-fan according to claim 17, wherein the bearing tube (238) comprises an outwardly protruding flange (239) that is equipped with an orifice (292) for the passage of the rigid electrical conductor (288).

19. The mini-fan according to claim 1, wherein the internal stator (44; 244) comprises a lamination stack (45; 245) and the external rotor (22; 222) comprises a permanent magnet (28; 228) coacting with the internal stator, said magnet being offset, relative to the lamination stack (45; 245) of the internal stator (44; 244), in such a way that a magnetic force is generated which acts upon the tracking cap (68; 268) in a direction toward the support surface (66; 266).

20. The mini-fan according to claim 1, wherein an end portion (32; 232) of the shaft (34; 234) is joined to the rotor (20) and in a transition region from the shaft (34; 234) to the rotor (20), a lubricant-moving surface (112; 312) is provided, which extends approximately radially and is located inside the bearing tube (38; 238), so that lubricant (110) thrown off during operation from said lubricant-moving surface, upon rotation of the rotor, is thrown into the interior of the bearing tube (38; 238).

21. The mini-fan according to claim 20, wherein said lubricant-moving surface (112; 312) is configured with an undercut configuration.

22. The mini-fan according to claim 20, wherein the bearing tube (38; 238) comprises, adjacent the rotor-side end facing away from the cover portion (62; 262), an inwardly protruding portion (114; 314).

23. The mini-fan according to claim 22, wherein the inwardly protruding portion (114; 314) is separated from the rotor (20), at least locally, by a gap (116; 316) that is configured as a capillary gap, in order to minimize escape of lubricant (110) through that gap.

24. The mini-fan according to claim 22, wherein the inwardly protruding portion is implemented, on its side facing toward the closure arrangement (62; 262), in the manner of an undercut (114; 314).

25. The mini-fan according to claim 1, wherein said bearing tube comprises, on its inner side, a portion (138) of reduced diameter for reception of the bearing arrangement (36; 236).

26. The mini-fan according to claim 25, wherein the radial bearing arrangement (36) comprises a portion (42) having an enlarged outside diameter, said outside diameter corresponding approximately to the reduced inside diameter of the bearing tube (38), in order to permit mounting of the radial bearing arrangement (36) in the bearing tube (38) in the region of said portion (42) having an enlarged outside diameter.

27. The mini-fan according to claim 26, wherein the radial bearing arrangement comprises bearing surfaces (48, 50), the bearing surfaces (48, 50) being located at least partially outside the portion (42) having an enlarged outside diameter.

28. The mini-fan according to claim 26, wherein the bearing surfaces (48, 50) of the radial bearing arrangement (36) are located at least partially at locations that are located outside the locations at which the radial bearing arrangement (36) is held in the bearing tube (38).

29. The mini-fan according to claim 26, wherein the necked-down portion (58; 258) of the rotor shaft (34; 234) comprises an annular groove (58), into which protrude, in the assembled state, said resilient radially movable latching hooks (60).

30. The mini-fan according to claim 1, further comprising a joint (100, 102) provided between the support flange (78) and the cover portion (62), the bearing tube (38) being held in a positively engaged manner between the cover portion (62) and the support flange (78).

31. The mini-fan according to claim 30, wherein the bearing tube (38) is pressed in a fluid-tight manner into the bearing-tube-receiving opening (80) formed in the support flange (78).

32. The mini-fan according to claim 30, wherein the radial projection (39) of the bearing tube (38) is held in a positively engaged manner between the cover portion (62) and the support flange (78).

33. The mini-fan according to claim 1, wherein a lubricant supply (64) is provided adjacent the sealed end (39) of the bearing tube (38).

34. The mini-fan according to claim 1, wherein the bearing tube (38) is held between the closure arrangement (62) and the support flange (78).

* * * * *